United States Patent [19]

Lohse et al.

[11] Patent Number: 4,592,669

[45] Date of Patent: Jun. 3, 1986

[54] DIRECT-RECORDING PRINTER AND HOUSING STRUCTURE THEREFOR

[75] Inventors: Gerhard Lohse, Erlangen; Johann Ramold, Buckenhof; Gerhard Klee, Erlangen, all of Fed. Rep. of Germany

[73] Assignee: Siemens Aktiengesellschaft, Berlin and Munich, Fed. Rep. of Germany

[21] Appl. No.: 692,970

[22] Filed: Jan. 22, 1985

[30] Foreign Application Priority Data

Jan. 21, 1984 [DE] Fed. Rep. of Germany ..... 3402067

[51] Int. Cl.[4] ..... B41J 29/02; B41J 11/66

[52] U.S. Cl. ..... 400/621; 400/120; 400/693; 225/32; 225/51

[58] Field of Search ..... 400/691, 693, 621, 120; 225/43, 42, 32, 39, 54, 51; 312/39

[56] References Cited

U.S. PATENT DOCUMENTS

| | | | |
|---|---|---|---|
| 2,336,842 | 12/1943 | Broeren et al. | 225/43 |
| 2,614,015 | 10/1952 | McGehee | 225/54 X |
| 2,695,208 | 11/1954 | Graham | 225/42 X |
| 2,869,951 | 1/1959 | Wooster | 312/39 |
| 3,905,462 | 9/1975 | Nowak | 197/1 R |

FOREIGN PATENT DOCUMENTS

| | | | |
|---|---|---|---|
| 2309684 | 9/1974 | Fed. Rep. of Germany . | |
| 61488 | 5/1980 | Japan | 400/621 |
| 101486 | 8/1980 | Japan | 400/690 |
| 2072101 | 9/1981 | United Kingdom | 400/120 |

*Primary Examiner*—Clifford D. Crowder

*Attorney, Agent, or Firm*—John Francis Moran

[57] ABSTRACT

A printer includes a printhead, a driven platen to advance the paper, which simultaneously provides counter-pressure to the printhead, and a paper-cutting bar which includes a cutting edge on which the paper can be cut. A paper compartment holds a paper supply, through which the platen is accessible for paper insertion. A cover plate or lid covers the paper compartment. In order to assure safe operation, the cutting edge of the paper-cutting bar is mounted outside of the most constricted space between the platen axle and the paper-cutting bar. The end of the paper-cutting bar includes the cutting edge thus covering the platen so that the end of the cover plate penetrates beneath or overlaps the specified end of the paper-cutting bar in the closed position. When moving from the closed position to the open position, a motion device causes the cover plate to be initially moved in a linear direction to clear the cutting bar and thereafter rotate around a rotary axle which is substantially parallel to the platen axle.

18 Claims, 8 Drawing Figures

DIRECT-RECORDING PRINTER AND HOUSING STRUCTURE THEREFOR

BACKGROUND OF THE INVENTION

A direct-recording printer is described which has printhead and a driven platen to advance the paper which at the same time provides counter-pressure to the printhead. A paper-cutting bar is provided having a cutting edge for cutting the paper. A paper compartment holds the paper supply, with the platen being accessible through the paper compartment for paper insertion. A cover for the paper compartment can be positioned either in the opened or closed positions.

Direct-recording printers of this type have been commercially available for some time. Such printers are, for example, categorized as lever (full character) printers, dot-matrix printers (ink-jet printers), but particularly as thermoprinters. All these printers require that the paper supply in the paper compartment be easily accessible, that reliable operation, in terms of the paper feed, be assured, and that, when cutting the paper, a clean cut point or cut line be defined. Normally, either paper stacked and folded in a Z-pattern (fan-folded) or paper rolls are utilized. It is particularly important that the paper compartment be easy to open, that the paper supply be easily replenished, and that, after replenishing, the paper web be easily aligned on the driven platen. It is also important that no difficulties arise between the printhead and the platen itself. Such difficulties can arise particularly in thermoprinters where a specific contact pressure prevails between the heating zone (printhead) of the thermoprinter and the platen.

Tests performed on a printer, by the assignee of the subject invention, in which the edge of the paper-cutting bar was mounted in close proximity to the surface of the platen demonstrated that there was a tendency for the paper web to become entangled around the platen. This occurred particularly after extended periods of printer non-use and is in all likelihood due to the deformation of the rolled paper. This is particularly problematic when the tangle occurs with a thermoprinter, since there the thermo head, as already noted, exerts substantial force on the platen, pressing down the paper. The increased temperature which arises after long use, along with this impact force, results in the above-mentioned paper deformation so that the undesired entanglement of the paper around the platen can occur when restarting the printer after some time.

A design in which the cover plate (lid) of the paper compartment would simply rotate when opening and closing would necessitate a space between the edge of the paper-cutting bar and the end of the cover plate. This space would result in contact between the paper and the platen and thus lead to the above-described negative entanglement effect.

SUMMARY OF THE INVENTION

An object of this invention is to provide a printer of the above specified type which permits reliable startup without the undesirable entanglement of the paper web on the platen after a period of standstill or non-use. In addition, the printer assures easy insertion of the paper.

This and other objects are achieved by the invention as follows. The edge of the paper-cutting bar is mounted outside of the most constricted space between the platen axle and the cutting bar. The end of the cutting bar includes the cutting edge which bridges the platen so that the end of the cover plate, when closed, penetrates beneath or overlaps a specified end of the cutting bar, and the cover plate, when moved from closed to open positions, is initially moved in a linear motion using a motion device and thereafter capable of rotation substantially around an axle aligned parallel to the platen axle.

The cutting edge is thereby placed above the end of the cover plate so that the paper web must first pass between the cover plate and the cutting edge with a paper strip remaining in this area after the cutting of the paper. When restarting the printer this overlap ensures that the paper end will pass out from the cover and not be entangled around the platen. In order to open the cover plate to service the printer, particularly in order to refill the paper supply, the cover plate is initially moved longitudinally and then rotated. After rotating or swivelling the cover plate, the paper compartment becomes directly accessible.

To assure a particularly easy insertion of the paper web between the platen and the printhead after inserting the paper, a further extension of this invention is the provision of a deflector to be installed between the paper compartment and the platen to guide the paper. Due to its flat surface, this deflector permits easy insertion of the paper web.

In order for the user not to insert the web in a skewed fashion, a further design feature provides for side retainers for the paper web on the deflector.

Preferrably the deflector has a bent or curved portion at its end for the paper, with this bent or curved portion serving as a counter-piece for a spring-action brake plate which acts on the paper. The brake plate, in particular, can support itself using a spring against the cover plate. Particularly good assurance of straight paper feed is attained if the brake plate is mounted only in the middle area of the paper web and is narrower than the paper web. The brake plate and spring can be designed as one piece, namely as a laminated spring. It has been found that with the design incorporating a spring-mounted brake plate, the paper cannot slip out of the preset path. It has also been found that if the paper web is inserted in a skewed fashion, it realigns itself automatically to the correct straight orientation.

A further design can provide for the deflector being equipped with a pivoting axle near the platen oriented parallel to the platen axle. With such a design, the storage area of the paper supply in the paper compartment is easily accessible once the deflector has been pivoted on its axle.

In accordance with a further preferred modification, a motion device is provided which can have a curved plate or cam which includes a curved guide edge or cam surface for a tracking pin. Such a curved plate is the principle component for engaging and fastening the cover plate.

If the printhead is a thermoprinter, then the printhead is thrust against the paper with the previously mentioned contact pressure, which, for example, can be 25 Newton, and thereby also against the platen. In order to assist the user in overcoming this force more easily, a further modification of the design includes a lever rod in the motion device which, due to manual pressure on the cover plate, reduces the contact pressure of the printhead on the paper. In this context it is assumed that for purposes of inserting the paper, the printhead is offset from the platen. For that purpose the preferred design foresees linking the opening of the cover plate with the printhead being offset from the platen by means of a mechanical coupling device so that both motions take place simultaneously.

A further design modification includes a spring in the motion device, preferrably a laminated spring, which both facilitates the action of moving the cover plate from the closed position and dampens the action as the cover plate attains the full open setting. This assures reliable operation and servicing of the printer. The user, moreover, benefits from the greater comfort of operation.

Other features and advantages of the invention will be apparent from the following description of the preferred embodiments, and from the claims.

For a full understanding of the present invention, reference should now be made to the following detailed description of preferred embodiments of the invention and to the accompanying drawings.

DESCRIPTION OF THE PREFERRED EMBODIMENTS

Identical or equivalent components in FIGS. 1 through 5 are identified by the same reference numbers.

Figure 1:
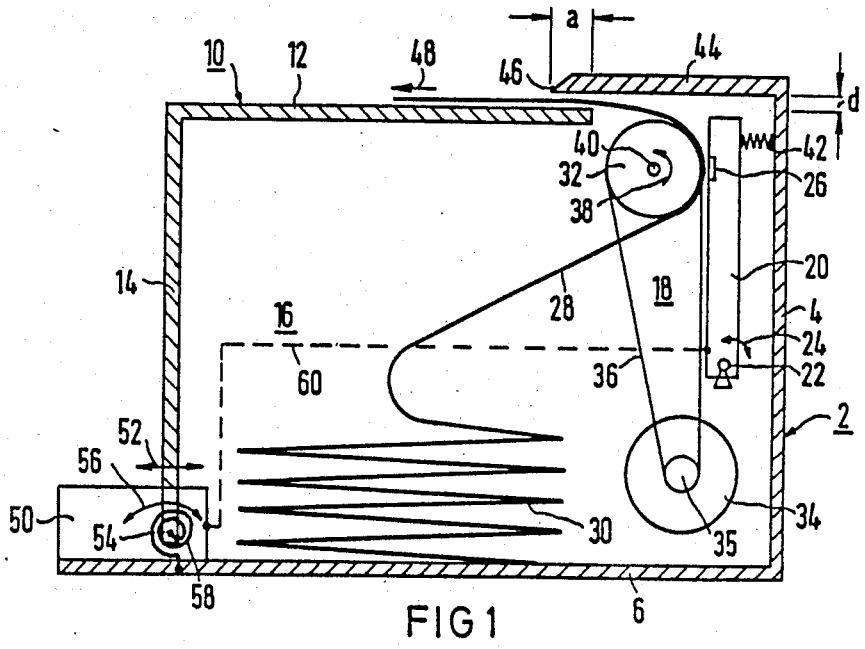
FIG. 1 is a side elevational view, partially in cross-section, of a general representation of one embodiment of a direct-recording printer with a printhead design as a thermoprinter in accordance with the invention.

FIG. 1 depicts a direct-recording printer which includes a housing 2 with a side wall 4 and a base 6. The interior of the printer can be closed by a cover or cover plate 10. This cover plate 10 is, as seen in the side view of FIG. 1, designed in an L-shape and consists of first and second plate sections 12 and 14. In the interior there is a paper compartment 16 and operating compartment 18. The operating compartment 18 contains a commercially available thermoprinter 20 which can be pivoted about a fixed-mounted axle 22 in the direction of the double arrow 24.

The thermoprinter 20 includes a printhead in the area of a writing zone 26, which can be fully controlled (by means not shown), thereby producing selective discolorations on the paper web 28 to create alphanumeric symbols or graphics.

The paper web 28 is fed from the paper supply 30 located in the lower portion of the paper compartment 16. As shown in FIG. 1, this paper web 28 can be introduced as Z-pattern or fan-folded paper sheets. Alternately, it can be in the form of a roll of paper.

To drive the paper web 28, there is provided a driving cylinder or platen 32 driven by an electrical drive 34 using a transmission 36 in the direction shown by the arrow 38. The platen axle is identified as 40.

The platen 32 serves not only to drive the paper but, at the same time, serves to provide a counter-pressure to the thermoprinter 20. The printer 20 impacts, for example, with a contact force of approximately 25 Newton in the area of the heating zone or printhead 26 on the paper web 28 and thereby on the platen 32. The contact force is generated by a spring 42 supported by the side wall 4. By pivoting around the axle 22, this impact force can be overcome.

The paper web 28 fed from the paper supply 30 is routed between the platen 32 and the thermoprinter 20 and thereafter between a paper-cutting bar 44 and the plate section 12. The paper-cutting bar 44 is fixed-mounted, i.e., connected to the housing 2 and fitted with a cutting edge 46. As can be seen, the cutting edge 46 is mounted away from the most constricted (here: perpendicular) space between the platen axle 40 and the paper-cutting bar 44. Thereby the left end of the paper-cutting bar 44, which supports the cutting edge 46, covers the drive platen 32.

FIG. 1 shows the closed position of cover plate 10. Therein, the first plate section 12 is parallel to the paper-cutting bar 44 on whose edge 46 the paper web 28 is cut. Tests have shown that good results are obtained if, when closed, the spacing "d" between the plate section 12 and the paper-cutting bar 44 is approximately 1 mm. Furthermore, these tests have shown that the overlap area "a" preferrably should have a width of approximately 2 mm. In other words, in the closed position the plate section 12 should penetrate beneath or overlap the paper-cutting bar 44 approximately 2 mm. Thus, an approximately 2 mm wide paper strip remains after cutting in the above-mentioned overlap area. After restarting the printer, during which process the paper web 28 starts moving in the arrow direction 48, the paper strip can pass easily from the printer, while not becoming entangled around platen 32. The overlap area "a" thereby serves as a restricting guide. This result is also obtained if after longer operation the printer is stopped at a high temperature so that due to the impact pressure of the thermoprinter 20 slight deformations of the paper result in the inserted paper area. Thus, this arrangement not only ensures reliable and clean cutting along the cutting edge 46, but also reliable operation.

The thermoprinter 20, the platen 32 and the storage area of the paper supply 30 are accessible from above through the paper compartment 16. To reach that area to insert paper, the cover plate (lid) 10 is lifted off the compartment opening. Thereby the cover plate 10 is moved between a closed and an open position. To execute this motion, the design includes a motion device 50. In the closed position depicted in FIG. 1, the end of the cover plate 10 penetrates or extends beneath the end of the paper-cutting bar 44. When the motion device 50 is activated, when the cover plate 10 moves from the closed to the open position, the cover plate 10 is first slid in a linear fashion towards the left, as indicated by the straight dual arrow 52, and thereafter the cover plate 10 is rotated counter clockwise about an axle 54 running parallel to the platen axle 40, as suggested by the double arrow 56. The manually operated motion device 50 engages the lower end of the second plate section 14. When closing the housing 2, the reverse cycle takes place. First, there is a clockwise rotary motion, and then a linear motion towards the right.

Schematically, FIG. 1 shows a spiral spring 58 which engages the rotary axle 54 on one end and the housing 2 or a linearly movable portion of the motion device 50 on the other. The spiral spring 58 comes into action during the specified rotation of the cover plate 10. In place of a spiral spring 58, another type of spring, for example a laminated spring, can be used. When the second plate section 14 has pivoted approximately 45° in reference to the perpendicular, the spring 58 is at rest. In positions which move away from this neutral spring setting, the spring 58 exerts a rotary force on the cover 10. The spring force holds the cover 10 in place in the closed position by pressing against a counter piece (not shown) and further serves to dampen the rotary motion when passing from the neutral spring setting to the open position (mentioned above), whereby the interior compartment is made fully accessible.

One important configuration of the printer provides that the opening of the paper compartment 16 is kinematically coupled with a portion of the thermoprinter 20 offset from the platen 32 and the paper 28 thereon. The coupling is schematically depicted in FIG. 1 by a dashed line 60 between the motion device 50 and the thermoprinter 20. The coupling can be implemented by a mechanical coupling device. This is intended to assure that with relatively little effort the user can move the offset portion of the thermoprinter 20 by opening the cover plate 10. It should, therefore, include a transmission device which uses, for example, the lever principle. The motion device 50 or the coupling device can thus comprise a lever assembly which reduces the contact pressure of the printhead 26 on the paper 28 upon manual pressure on the cover plate 10.

Figure 2:
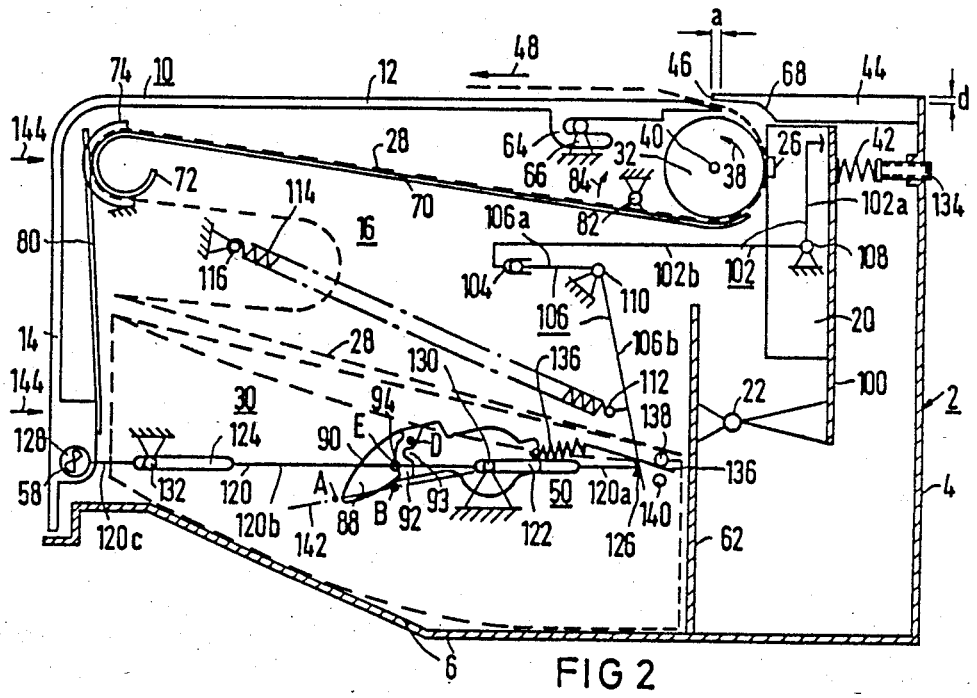
FIG. 2 is a schematic or functional representation of the printer shown in FIG. 1, showing further design details.

FIG. 2 depicts a modified design of the printer in accordance with FIG. 1, showing additional details. Identical or equivalent components are identified by the same reference numerals. In this design the housing 2 is designed more in accordance with practical requirements. It contains an additional partition 62.

This design also provides for the cover plate 10 to have an L-shape in the side-view. The first plate section 12 has a latch or locking key 64 which receives a stationary pin 66 in the shown closed position. When opening and closing the printer, the latch 64 simultaneously serves as a guide in the horizontal direction. The L-shaped design of the cover plate 10 again ensures that after opening the paper compartment 16, it is open for servicing to the maximum extent possible, i.e., that the paper supply 30 can be easily replenished and the end of the paper web 28 can be easily inserted between the platen 32 and the thermoprinter 20.

According to FIG. 2, the paper-cutting bar 44 is also fixed-mounted to the housing 2. The cutting edge 46 extends from a curved alignment edge or surface 68 which facilitates guidance of the paper web 28.

Figure 3:
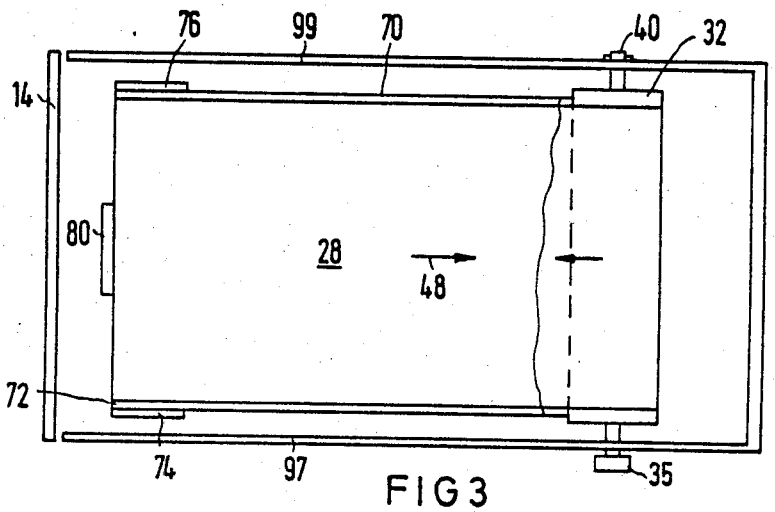
FIG. 3 is a top plan view of the printer shown in FIG. 2.

In accordance with FIG. 2, a longitudinal deflector 70 is provided between the paper supply 30 and the platen 32. This serves to guide the paper web 28 and permits easy insertion when feeding since it has a smooth contact surface. On the left end, the deflector 70 has a rounded portion 72 for the paper web 28. At this location the deflector 70 has side retainers 74, 76 on both edges for the paper track, of which only retainer 74 can be seen from FIG. 2. Both retainers 74, 76, however, are shown in FIG. 3. These side retainers 74, 76 ensure that the paper web 28 can be inserted by the user in a skewed fashion only to a certain extent.

At the same time, the rounded portion 72 of the deflector 70 serves as a counter-piece for a spring-mounted brake plate 80 abutting against the paper web 28. In principle, the spring-mounted brake plate 80 can be designed as a plate (not shown) which rests against the cover plate 10, particularly its second plate section 14, by means of a helical spring. In the subject embodiment, however, the spring-mounted brake plate 80 is designed as one component, i.e., as a laminated spring whose lower end is mounted on the cover plate 10 and whose upper end, pre-tensioned or biased, rests on the paper web 28 and thus on the rounded portion 72. As may be seen from FIG. 3, the brake plate 80 is arranged in the mid-section of the paper web 28 and is narrower than the paper web 28. The laminated spring 80 assures the paper web's straight orientation. Even when inserted into the guides 74, 76 in a skewed fashion, the paper web 28 straightens itself out automatically after a short period of operation, as has been shown in tests.

The deflector 70 is provided with a pivoting axle 82 in the immediate proximity of the platen 32. This pivoting axle 82 is aligned parallel to the platen axle 40. When replenishing the paper supply 30 and offsetting and pivoting the cover plate 10, the deflector 70 is pivoted or rotated around the pivoting axle 82 in the direction of the arrow 84 so that, again, the paper storage area or compartment 16 is readily accessible.

FIG. 2 schematically shows that the motion device 50 comprises a curved plate 88 which has a bent, curved edge or cam surface 90. This curved edge 90 runs along the left outer edge of the curved plate 88 and along the left edge of a milled groove 92. As will become clear later on, the curved edge 90 is tracked by means of a tracking pin 94 during opening and closing of the printer, resulting in predetermined involvements and defined positions.

FIG. 2 schematically depicts a preferred design of the motion device 50. This motion device is based on the assumption that the thermoprinter 20 is mounted on a mounting plate 100 which can be swivelled around a horizontal axle in a bearing 22 located at the partition 62. The motion device 50 includes a first pivoting lever 102 consisting of two arms **102*a* and 102*b* which are arranged at an angle approximately 90° in relation to one another. In the closed position shown, the free end of arm 102*a* is positioned close to the mounting plate 100, e.g., one half a millimeter. The other arm 102*b* has a 180° bend at its free end and is, at this location, provided with an interlocking longitudinal guide 104. In a practical realization, this longitudinal guide 104 can be designed as a longitudinal hole. The engaged end of a second pivoting lever 106 with arms 106*a* and 106*b* is received within the longitudinal guide 104. The two arms 106*a*, 106*b* are arranged in an angle of approximately 110° relative to each other. The first pivoting lever 102 can be rotated in a bearing 108 and the second pivoting lever 106 in a bearing 110. The free end of arm 106*b* is oriented in the direction of base 6**.

The arm **106*b* has an extension arm 112, which is engaged by one end of a pre-tensioned tension spring 114. The other end of the tension spring 114 is hinged in a bearing 116. The tension spring 114 serves two purposes, as will be obvious later. Firstly, it urges the thermoprinter 20 away from the platen 32, and, secondly, it forces a sliding arm 120 leftwards in the direction of the second plate section 14**.

The sliding arm 120 is an elongated device comprising a first section 120*a*, a first longitudinal guide 122, a second section 120*b*, a second longitudinal guide 124, and finally a third section 120*c*. The right end of the sliding arm 120 is in contact with the second arm 106*b* at a contact point 126. The left end of the sliding arm 120 is connected to a rotary joint 128. The rotary joint 128 has a spring, specifically a clamping band, already incorporated in its design. The function of the spring corresponds to the function of the helical spring 58 in FIG. 1.

A pin 130 protrudes into the first longitudinal guide 122. The pin 130 is supported by a side wall of the printer (not depicted in FIG. 2), and protrudes also into a correspondingly shaped hole in the curved plate 88, thus permitting its rotation around pin 130. The second longitudinal guide 124 also comprises a pin 132 which is supported by a side wall of the printer. The guides 122, 124 make sure that the sliding arm 120 can only move in a horizontal direction. Along with the sliding arm 120, the tracking pin 94 is moved which is connected to the second section 120*b*.

It should be pointed out that the components 102, 106, 114, 120 and 128 are provided on both side walls 97 and 99. Accordingly, there are two identical mounting plates 100 with bearings 22 and contact pressure springs 42. The contact pressure springs 42 can be provided with adjusting screws 134 for adjusting the nominal tension in the springs.

In order to maintain the curved plate 88 in a neutral position, a pre-tensioned tension spring 136 is provided. The left end of the tension spring 136 is connected to the end of the curved plate 88. Its other end extends as a straight wire which is positioned between two pins 138, 140 in the depicted design. It should be pointed out that in this context the pre-tensioned tension spring is not used as a tension spring in the traditional sense, but as a spiral spring. The above-mentioned neutral position of the curved plate 88 is selected so that the reference line 142, which is shown as a dot dash line crossing the pin 130, has the same direction as the sliding arm 120. When the neutral position is attained, the tracking pin 94 is in the illustrated position B before the cover plate 10 is moved out in a linear fashion, and in depicted position A after it has been moved out in a linear fashion. Both positions A and B are located a slight distance ahead of the actual curved plate 88.

The following description details the opening of the printer in accordance with FIG. 1. The user presses any location of the plate section 14 in the direction of the arrow 144, thus causing the sliding arm 120 to move to the right. Up to this time, the tracking pin 94 was in the notch of the tracking curve 90, as illustrated (see position E). Now the tracking pin 94 also moves to the right into groove 92 so that the tension spring 136 can swivel the curved plate 88 into the neutral position in accordance with position B. The swivelling action occurs around the pin 130. When the user no longer presses the second plate 14, the sliding arm 120 moves leftwards through the effect of the force of the tension spring 114, which is coupled with the sliding arm 120 via the lever 106*b*. As the second plate 14 is connected with the sliding arm 120 via the rotary joint 128, the plate 14 is also pressed leftwards, whereby the locking key 64 moves away from the pin 66, releasing the pin 66. Now the spring 58, which is incorporated into the rotary joint 128, specifically the above-mentioned clamping band, can swivel the entire cover plate leftwards into a 45° position. The cover plate 10's own weight assures that this 45° position is exceeded, with the spring incorporated into the rotary joint 128 ensuring a dampening of the motion. Possibly with the user's help, a 90° position is attained so that the interior space of the printer is easily accessible for paper loading. As has been mentioned earlier, the deflector 70 is pivoted around pivoting axle 82 before loading.

It should be pointed out specifically that during the linear motion of the sliding arm 120 to the left, the thermoprinter 20 is swivelled rightwards around the bearing 22, thus moving away from platen 32. This occurs due to the effect of tension spring 114 via the second pivoting lever 106 and the first pivoting lever 102, whose end thereby presses against the upper end of the mounting plate 100. The force of spring 42 counteracts this movement. Thereby, the relatively great strength of the two springs 42 is overcome by the tension springs 114 due to the relatively high degree of transmission of the two pivoting levers 106, 102. The sliding arm 120, the two pivoting levers 106 and 102 as well as the mounting plate 100 thus correspond to the coupling device 60 in FIG. 1.

In the open position thus described, the paper web 28 can be inserted without effort, after the deflector 70 has tilted back into the position shown in FIG. 2. Now the user can readily insert the paper web 28 along deflector 70, whose end is slightly bent, between the thermoprinter 20 and the platen 32 until it extends beyond the cutting edge 46.

During the leftward motion of the sliding arm 120, as explained above, the tracking pin 94 has moved clockwise on the curved plate 88 from position B to position A. The tracking pin 94 continues its path during the subsequent closing of the cover plate 10.

Naturally, this process is preceded by a swivelling back of the the cover plate 10 around the rotary joint axle 128 rightwards. During this swivelling back action the tracking pin 94 is still in the A position. The pin 94 does not move clockwise along curve 90 to a position D determined by a key 93 within groove 92, until the user moves the second plate 14 again rightwards in a linear fashion in the direction of the arrow 144. During this linear motion the sliding arm 120 not only moves to the right, but the locking key 64 simultaneously snaps into place beneath the pin 66. At the same time, the lever assembly 106, 102 is turned such that the springs 42 can cause the thermoprinter 32 and the heating zone 26 to engage again the platen 32 and the paper web 28 thereon via the mounting plate 100. When the user removes his hand from the second plate section 14, the plate section 74 moves slightly leftwards again, whereby the tracking pin 94 moves from the position D into the starting position E. Thus, the direct-action printer is again ready for operation.

Figure 4:
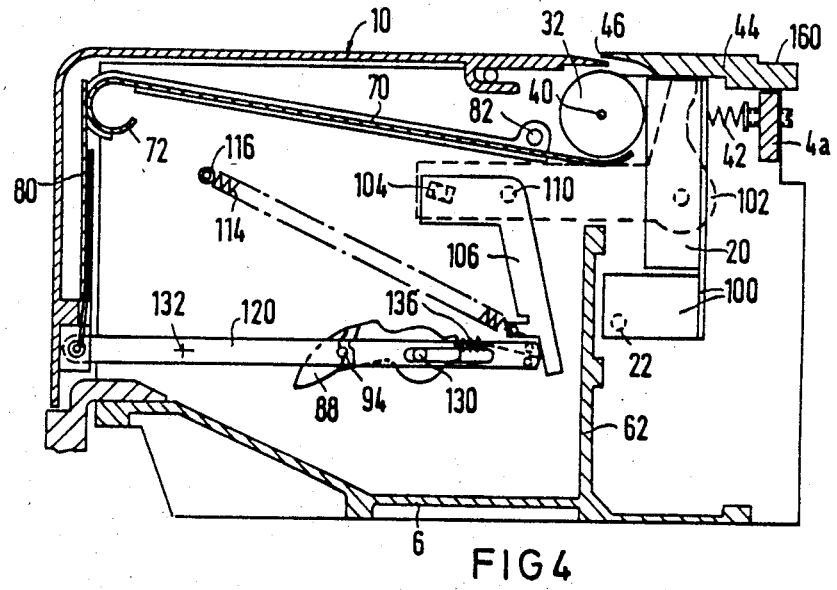
FIG. 4 is similar to the view shown in FIG. 2, but showing a different embodiment of a printer with a printhead, also designed as a thermoprinter, showing a section taken along line IV—IV in FIG. 5.
Figure 5:
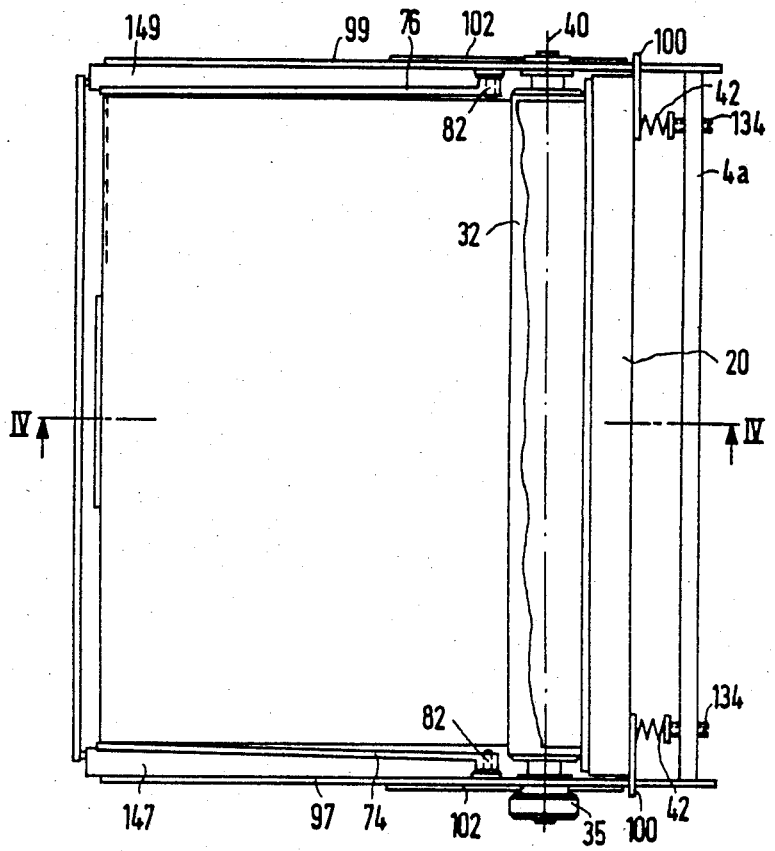
FIG. 5 is a top plan view on the printer shown in FIG. 4.

FIGS. 4 and 5 depict another embodiment in accordance with the invention. It can be seen that in this design the two pivoting levers 102 and 106 are each designed as integral units. The interlocking longitudinal guide 104 consists of an oblique longitudinal hole, into which a pin engages. FIG. 4, which represents a section along the line IV—IV, shows the first pivoting lever 102 in dotted outlines. This is due to the fact that the pivoting lever 102 is mounted outside the side wall 99. Correspondingly, the end of the arm 102*a* acts on the mounting plate 100 outside the side wall 99.

According to FIG. 5, one cover 147 and 149, respectively, is provided on the side walls 97, 99. In order to make FIG. 4 clearer, the cover 149 was omitted in the figure. The covers 147, 149, which are preferrably made of plastic, serve to protect the sensitive components.

In contrast to FIGS. 2 and 3, the side retainers 74, 76 in FIGS. 4 and 5 have an elongated design. The retainers 74, 76 are deflector rails in this instance, which extend almost throughout the entire length of the outer edge of the deflector 70. Simultaneously, the retainers 74, 76 position the pivoting axles 82.

In this configuration the rear wall 4 is reduced to a cross connection 4*a*. This was done for thermal reasons, because the electronic components are located to the right of the cross connection 4*a*. In order to close the printer on its right-hand side as well, a connecting groove 160 is provided in the paper-cutting bar 44, into which a housing can be slid (not depicted).

Contrary to the configuration in accordance with FIGS. 2 and 3, a second longitudinal guide 132 is shown in FIG. 4 as a complementary component. In the design the sliding arm 120 contains a pin, while the longitudinal groove is located in the side wall 99.

Figure 6:
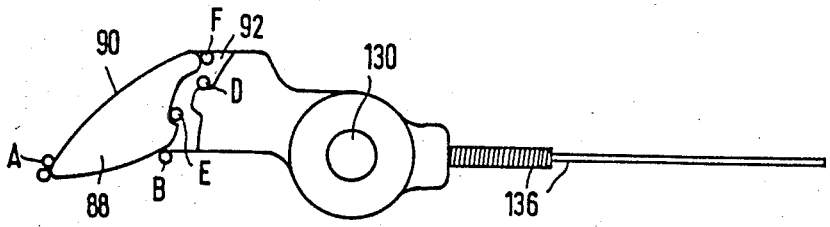
FIG. 6 is a plan view of a curved plate indicating various pin positions.

FIG. 6 illustrates the curved plate 88 and various positions of the pin 94 associated therewith. It will be noted that the positions A, B are located on the circumference of the curved plate 88, whereas the positions E, D, F are located in the groove 92. If the cover plate 10 is opened up, the pin 94 will assume position A, and if the cover plate 10 is closed, it will assume position E.

Figure 7:
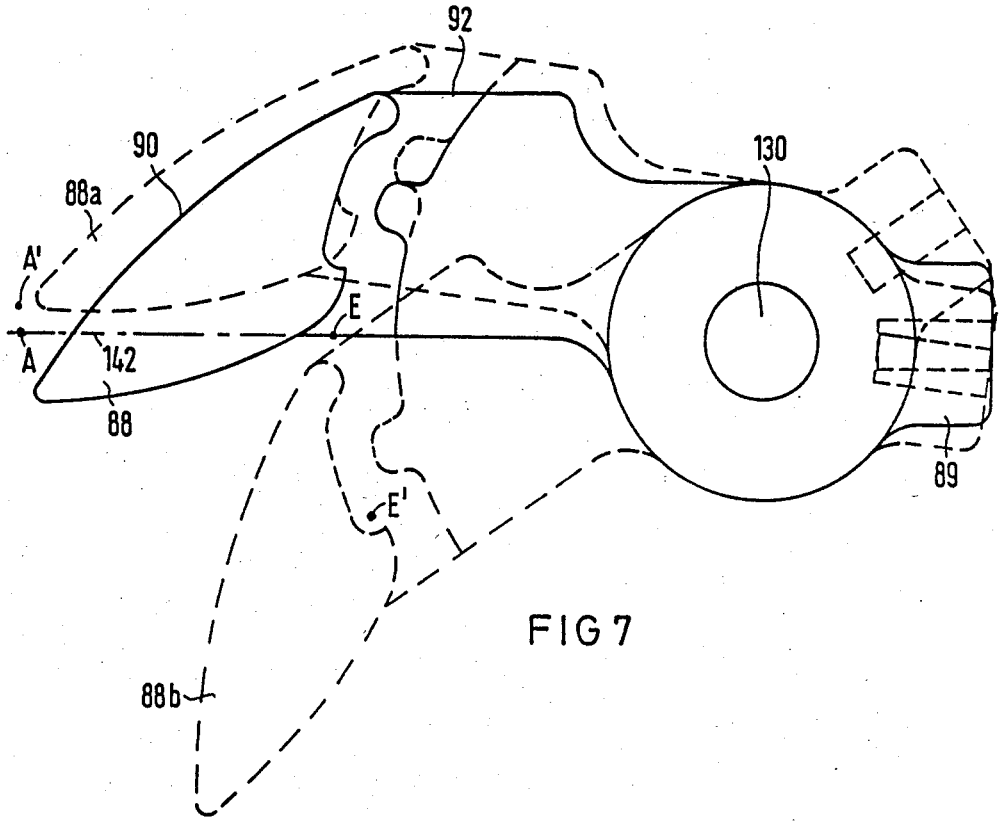
FIG. 7 is a plan view of the curved plate shown in FIG. 6 on an enlarged scale.

In FIG. 7 the curved plate 88 is illustrated on an enlarged scale. In this illustration the groove 92 is not completely shown. In addition there are illustrated the two extreme positions of the curved plate 88 while swiveling about the axle 130, which extreme positions are denoted by 88*a* and 88*b*, respectively. The position 88*a* will occur while the cover plate 10 is opened up, and the position 88*b* will occur while the cover plate 10 is closed. The curved plate 88 is provided with an end piece 89 for receiving an end of the spring 136. For this purpose, the end piece 89 is provided with a hole therein.

It will be noted from FIGS. 6 and 7 that during the opening and closing operation the pin 94 will travel along the line 142 which is stationary with respect to the housing. In FIG. 7, the positions A and E of the pin 94 are designated on the line 142. Close to the curved plate 88*a* shown in dashed lines, the position A′ of the pin 94 is illustrated, where the cover plate 10 is opened. Correspondingly, the position E′ of the pin 94 is indicated at the dashed plate 88*b*, in which position E′ the cover plate 10 is closed.

Figure 8:
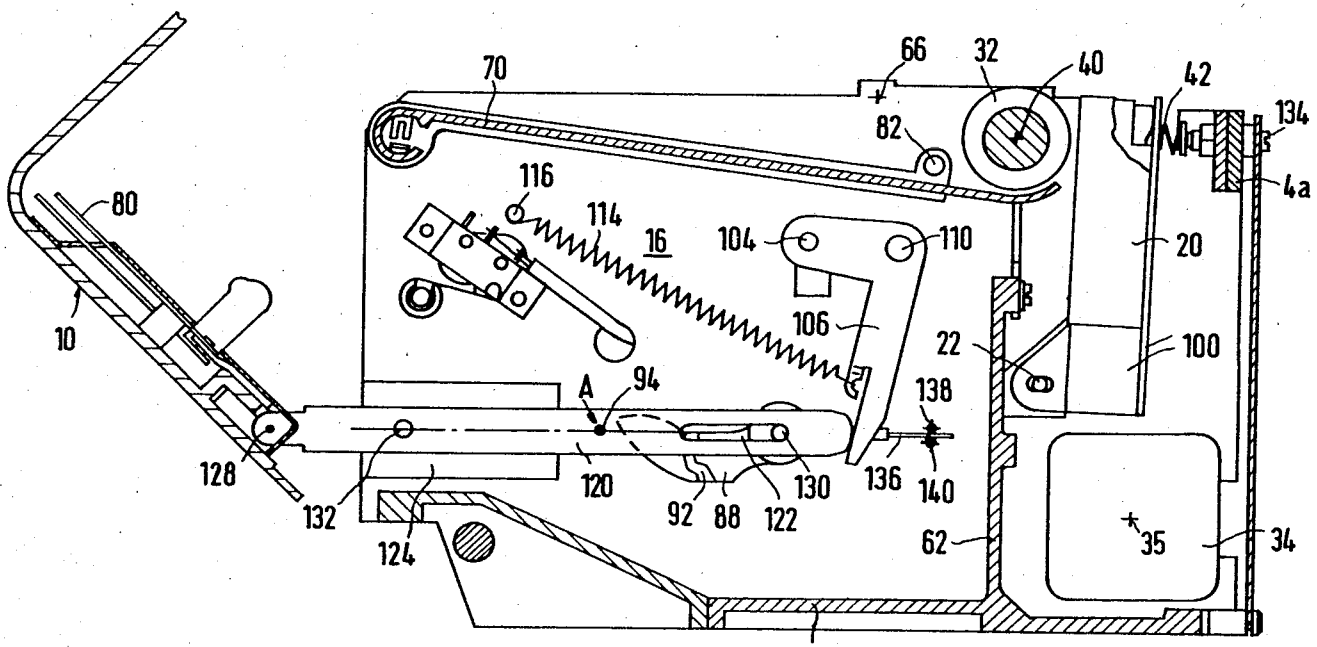
FIG. 8 is a sectional view of the printer shown in FIG. 4 having its cover plate opened up to an extent of 45°.

FIG. 8 is a view of the printer according to FIG. 4 showing more technical details.

In FIG. 8 the cover plate 10 is partially open at an and has assumed position of 45°. In this 45° position, the spring device or clamping band 85 in the rotary joint 128 is not biased. In this position, the curved plate 88 is rotated about axle 130 such that the pin 94 is located in position A. The axle 130 is in its end position in the hole 122. During handling, the weight of the cover plate 10 will subsequently completely open up the compartment 16, that is, the cover plate 10 will assume a 90° position.

There has thus been shown and described a novel direct-recording printer which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. A direct-recording printer comprising a printhead; a platen rotatably mounted on an axle and arranged proximate to said printhead for advancing a paper web past said printhead and for providing a counter pressure to said printhead; a paper-cutting bar including a cutting edge for cutting the paper web once it has passed said printhead; a paper storage compartment for holding a paper supply, said platen being accessible through said paper storage compartment for insertion of paper; a cover plate for said paper storage compartment mounted for movement between opened and closed positions, said cover plate having an L-shaped cross-section and having a first and second section angled with respect to each other; said cutting edge of said cutting bar being mounted exterior of a region defined by the closest distance between said platen axle and said paper cutting bar, said paper cutting bar including said cutting edge extending over said platen, said first section of said cover plate when in the closed position overlapping and extending beneath a predetermined portion of said paper cutting bar; first motion means for initially moving said cover plate linearly to clear said paper cutting bar when moving said cover plate to the open position; said first motion means being operatively connected to said cover plate, said second section thereby serving as an operation element for initiation of said linear motion; and second motion means for rotating said cover plate about an axis parallel to said platen axle after said cover plate has cleared said cutting bar.

2. A printer in accordance with claim 1, wherein in the closed position said first section of said cover plate and said paper-cutting bar are spaced from each other approximately 1 mm.

3. A printer in accordance with claim 1, wherein said first section of said cover plate penetrates beneath said paper-cutting bar by a depth or approximately 2 mm. in the closed position.

4. A printer in accordance with claim 1, wherein said paper-cutting bar is fixed-mounted.

5. A printer in accordance with claim 1, wherein said first section is aligned substantially parallel to said paper cutting bar and said second section is substantially normal thereto, when said cover plate is in the closed position.

6. A printer in accordance with claim 5, wherein said second motion means comprises a motion device acting on said second section of said cover plate which is opposite to said platen in order to perform a rotary motion.

7. A printer in accordance with claim 1, further comprising a deflector provided between said paper supply and said platen to guide the paper.

8. A printer in accordance with claim 7, wherein said deflector is provided at one of its ends initially contacting the paper web with a rounded portion; and a spring-mounted brake plate acting on the paper at said rounded portion which serves as a counter piece for said brake plate.

9. A printer in accordance with claim 8, wherein said brake plate supports itself against said cover plate by means of a spring.

10. A printer in accordance with claim 8, wherein said brake plate comprises a laminated spring one end of which is mounted on said cover plate.

11. A printer in accordance with claim 8, wherein said brake plate is arranged in the mid-section of and is narrower than the paper web.

12. A printer in accordance with claim 7, wherein said deflector is provided with a pivoting axle in the proximity of said platen, which is substantially parallel to said axle of said platen.

13. A printer in accordance with claim 1, wherein said deflector is provided with side retainers for aligning the paper web.

14. A printer in accordance with claim 1, wherein said first motion means comprises a motion device which includes a curved plate which has a curved edge or cam surface and a tracking pin which abuts against and follows said curved edge or cam surface.

15. A printer in accordance with claim 14, wherein said first motion device comprising a lever rod, which reduces the impact pressure of said printhead on the paper when said cover plate is moved manually.

16. A printer in accordance with claim 1, further comprising mechanical coupling means for coupling said cover plate with said printhead to thereby offset said printhead from the platen with opening of said cover.

17. A printer in accordance with claim 16, wherein said motion device comprising a spring, which facilitates motion away from the closed position and dampens entry into the open position of said cover plate.

18. A printer in accordance with claim 17, wherein said spring comprises a laminated spring acting in the center of a rotary axle of said motion device.

* * * * *